US006334241B1

(12) United States Patent
Flodin

(10) Patent No.: US 6,334,241 B1
(45) Date of Patent: Jan. 1, 2002

(54) CONTAINER LOCK

(76) Inventor: Yngve Flodin, Basunvägen 13, S-302 41 Halmstad (SE)

( * ) Notice: Subject to any disclaimer, the term of this patent is extended or adjusted under 35 U.S.C. 154(b) by 0 days.

(21) Appl. No.: 09/485,008

(22) PCT Filed: Jul. 30, 1998

(86) PCT No.: PCT/NO98/00227

§ 371 Date: Jan. 28, 2000

§ 102(e) Date: Jan. 28, 2000

(87) PCT Pub. No.: WO99/06307

PCT Pub. Date: Feb. 11, 1999

(30) Foreign Application Priority Data

Aug. 4, 1997 (NO) ..... 973585

(51) Int. Cl.[7] ..... B65D 90/00
(52) U.S. Cl. ..... 24/287
(58) Field of Search ..... 410/82, 83, 73, 410/76; 24/287, 590–597

(56) References Cited

U.S. PATENT DOCUMENTS 3,980,185 A * 9/1976 Cain
4,108,081 A * 8/1978 Blanz
4,564,984 A * 1/1986 Takaguchi
5,002,418 A * 3/1991 McCown et al.

FOREIGN PATENT DOCUMENTS

DE 3642399 A1 6/1988
DE 19534767 3/1997
WO WO 8901907 3/1989

* cited by examiner

*Primary Examiner*—James R. Brittain
(74) *Attorney, Agent, or Firm*—Rodman & Rodman

(57) ABSTRACT

The invention relates to a container lock including an upper and a lower locking lug (1, 24) capable of being passed into a respective lock groove (51, 53) in juxtaposed container corners (50, 52) and turned so as to lock therein in that the lower locking lug (24) is rotatably and translationally mounted in a housing (21) connected to the upper locking lug (1) and having a shaft (14) capable of limited movement in the axial direction, which is lock-actuated by a spring (9) in the housing (21) in a downward direction, and between the housing (5, 21) and the shaft (14) there are arranged guide means (13, 8) which permit a locking rotation of the lower locking lug (24) on upward movement of the shaft (14). The invention is characterized in that the lower locking lug (24) is designed to have a pressure ball (25) intended for abutting interaction with a bottom of a lock groove (53) when an upper container is placed on a lower container. The housing (21) can thus be pressed down onto the shaft (14), whereby a gap is formed between a downward facing circumferential annular surface on the shaft (14) and the lower part of the housing (21), and in the housing (21) there is arranged a locking device including spring-actuated (31) locking arms (16, 17) which will move in towards the shaft (14) to a position in the gap below the circumferential annular surface and thus as a spacer prevent the return axial movement of the shaft (14).

10 Claims, 12 Drawing Sheets

CONTAINER LOCK

The invention relates to a container lock including an upper and a lower locking lug capable of being passed into a respective lock groove in juxtaposed container corners and turned so as to lock therein in that the lower locking lug is pivotally and translationally mounted in a housing connected to the upper locking lug by means of a shaft capable of limited movement in the axial direction, which shaft is lock-actuated by a spring in the housing in a downward direction, and between the housing and the shaft there are arranged guide means which permit a locking rotation of the lower locking lug on upward movement of the shaft.

DE 195 34 767 A1 makes known a container lock having two mutually rotatable lugs. These lugs are capable of moving vertically relative to one another. When two containers are brought together, the lugs are released. They are under spring tension and pivot into engagement or locking position. This locking position can be released by means of a handle mechanism.

DK 157987 B makes known a container lock having a lower locking lug which is pivotally mounted in a housing connected to the upper locking lug. Spring pre-tensioning is used for the lower locking lug.

According to the invention, there is proposed a container lock as mentioned above, characterised in that the lower locking lug is designed to have a pressure ball intended for abutting interaction with a bottom of a lock groove when an upper container is placed on a lower container, so that the housing is thus pressed down over the shaft, thereby forming a gap between a downward facing circumferential annular surface on the shaft and the lower part of the housing, and in that in the housing there is arranged a locking device, including spring-actuated locking arms which will move in towards the shaft to a position in the gap below the circumferential annular surface and thus as a spacer prevent the return axial movement of the shaft.

A container lock of this kind can by means of its upper locking lug be passed into a lock groove in a subjacent container corner and turned so as to lock therein. A container lock of this kind is arranged in each corner of the container. The container can then be brought into position over another container by means of suitable lifting tackle and lowered down thereon so that the respective lower locking lugs pass into the upward facing lock grooves in the upper container corners of the lower container. The spherical end faces of the lower locking lugs will come to rest against the bottom of the respective upward facing lock grooves. Thus, the lower locking lug and associated shaft will be displaced upwards in the housing, with simultaneous locking rotation as a consequence of the said guiding means between the housing and the shaft.

The two containers will now be locked together and the lower container can thus be lifted together with the upper container.

The unlocking force will be very small, almost zero, because the supporting arms can swing relatively freely out of and into the gap which will be formed between the head of the shaft and a lower face in the housing when the vessel, for example, is in dock, but is almost impossible to open when the vessel heels at speed on the open sea.

Instead of the upper container, there may be used a lifting yoke having four so-called container corners wherein the container locks can be inserted.

It is particularly advantageous if the locking arms of the locking device include a hinged pair of claws designed to have interacting swivel toothing and which grip about the shaft.

Furthermore, it would be advantageous to provide a spring-actuated operating member for the locking arms.

The operating member of the locking device and tension spring may to advantage be arranged in a radially projecting part of the housing.

Advantageously, the spring for tension-actuation of the shaft may also be a spring which acts against the free end of the shaft.

The said guide means can advantageously include a helical guide groove on the shaft and a guide pin fixedly arranged radially in the housing and which runs in the guide groove.

In the upper locking lug or housing there may advantageously be provided ball-and-groove locking pins intended for interaction with walls in a lock groove.

The shaft may to advantage be a screw bolt which is screwed into the lower locking lug.

It is especially advantageous if the housing is sealed off from the outside and filled with oil or the like.

The said operating member can according to the invention advantageously be drive-connected to an electromagnet.

The invention will now be explained in more detail with reference to the drawings, wherein:

FIG. 1 shows in exploded view the individual components of a container lock according to the invention. The assembled components are shown in FIGS. 8, 9 and 11–14.

Figure 1:
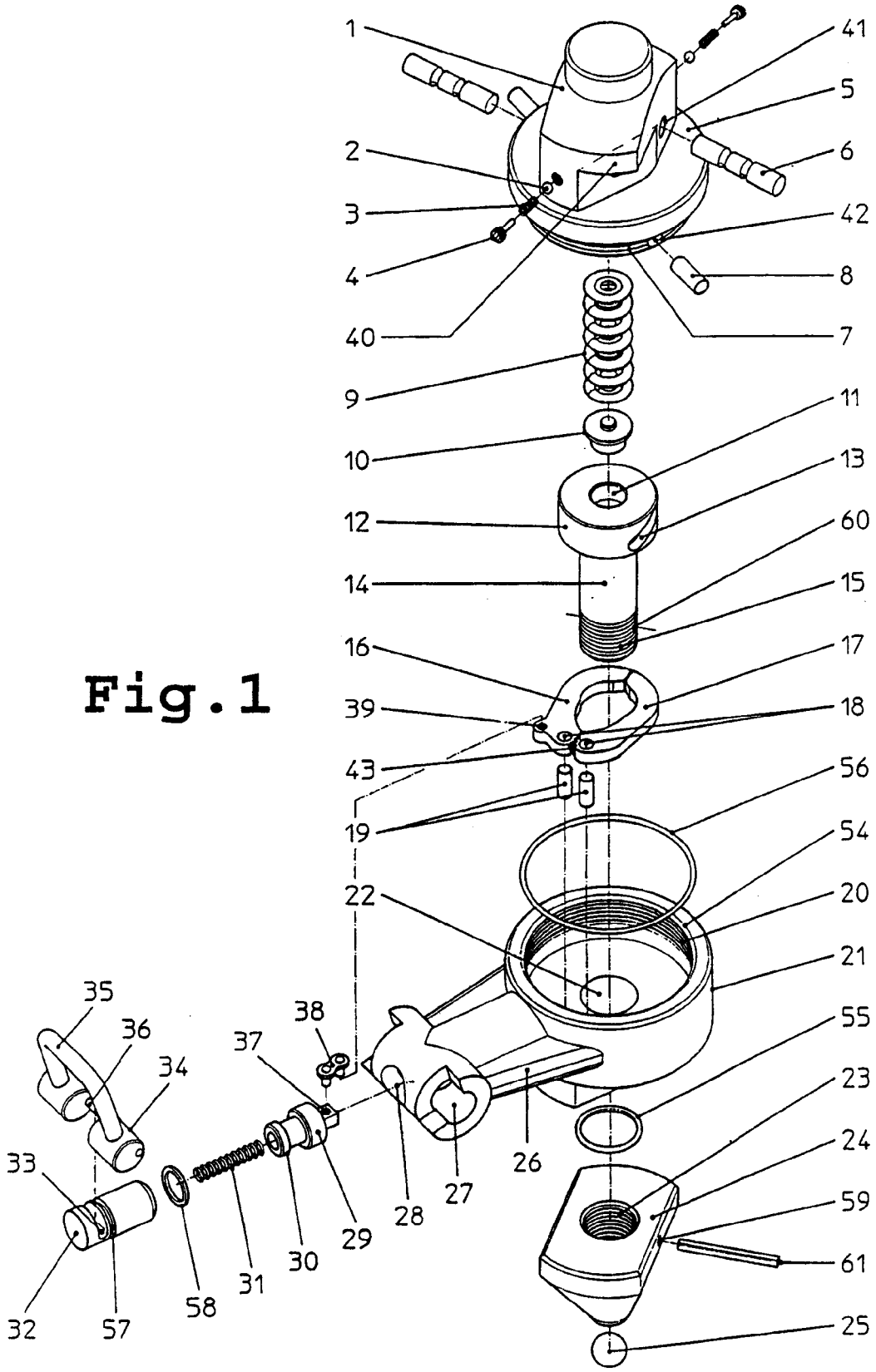
FIG. 1 is an exploded view of a container lock according to the invention.

A cup-shaped housing 21 has an upward facing mouth having an internal threaded portion 20. In the bottom of the housing 21 there is a through bore 22. A lower locking lug is indicated by means of the reference numeral 24. This lower locking lug has a threaded blind hole 23, intended for screw-interaction with a threaded portion 15 on a bolt 14. The bolt 14 and the locking lug 24 are screwed together in that the bolt 14 is passed down through the bottom bore 22 in the housing 21 and screwed into the threaded bore 23 in the locking lug 24. A pin 61 secures the connection. In the lower end thereof, the locking lug 24 has a thrust ball 25 that has been rolled into place.

An upper locking lug 1 is made integrally with a part 5 which has an external threaded portion 7 intended for screw-interaction with the internal threaded portion 20 in the housing 21. The upper locking lug 1 has two diametrically opposite oblique notches 40 (only one is shown).

The bolt 14 acts as a shaft for the lower locking lug 24 in the housing 21 and has a head 12 with two diametrically opposite helical grooves 13 (only one is shown) on the circumferential surface of the head. When the container lock is assembled, these guide grooves 13 will enter engaging interaction with guide pins 8 which run in radially extending bores 42 in the cover part 5. On its underside, the cover part 5 has a depression for receiving the head 12 of the bolt 14, so that the guide pins 8, when pushed in, will enter the respective guide groove 13.

The head 12 of the shaft 14 has a blind bore 11 for receiving an abutment part 10 which forms centring abutment for a coil spring 9. The upper end of the coil spring goes against the bottom surface of the said bottom depression in the cover part 5. When the container lock is assembled, the spring 9 will thus be squeezed between the cover part 5 and the head 12 of the shaft or bolt 14 and tension-actuate the shaft 14, and thus also the lower locking lug 24 screwed together therewith, in a downward direction.

In the housing 21 and in a radially projecting part 26 there is arranged a locking device for the shaft 14. This locking device includes a pair of claws 16, 17 which are pivotally mounted in the housing 21 by means of pivot pins 19, which run in bores 18 in respective claws 16, 17. The claws 16, 17 have interacting toothing 43, and one of the claws 16 has an extended portion with a bore 39 for receiving a pin on a forked member 38, the other pin of which runs in a bore 37 in a rod portion 29. This rod portion 29 has a blind bore for receiving a spring 31. The rod portion 29 is a part of a telescopic operating rod, the other end of which is formed by a rod portion 32. This rod portion 32 also has a blind bore for receiving the spring 31. The two rod portions 29, 32 are brought together with inserted spring 31 so that the outer portion 32 will grip around the collar 30 on the portion 29. By means of rolling or suitable compression, the rod portion 32 can be brought into engagement behind the collar 30, so that the two rod portions 29, 32 will be capable of limited axial displacement relative to one another, with the spring 31 fixed therebetween.

A U-shaped member 35 is secured at the two ends thereof to a respective cylindrical body 34. The two cylindrical bodies 34 have a respective eccentric bore for receiving a cross bar 36. In the outer rod portion 32, there is a transverse groove 33 for receiving and interacting with the eccentrically positioned cross bar 36. The cylindrical bodies 34 are designed for insertion in recessed portions 37 at the end of the housing part 26. The housing part 26 has a radial through passage 28, which thus extends from outside the housing 26 and opens into the interior of the actual housing 21.

The container lock shown in an exploded view in FIG. 1 is assembled in the following way:

The rod portions 29, 32 are put together with the spring 31 and the rod portion 32 is rolled in the end, on the rear of the collar 30, thus producing a telescopic rod. This is inserted into the passage 28 so that the bore 37 in the rod portion 39 is accessible inside the housing 21. The pair of claws 16, 17 are put in together with the pivot pins 19, and the forked member 38 is put in place in the respective bores 37, 39, so that the rod portions 29, 32 which form the operating rod are coupled to the pair of claws 16, 17. In this connection, reference is also made to FIGS. 8, 9, 11–14. The bolt 14 is put together with the spring 9 and the cover part 5 and thus with the upper locking lug 1, the guide pins 8 being passed into the respective bore 42 and into engaging interaction with a respective guide groove 13 on the bolt head 12. The assembly thus obtained is then connected to the lower locking lug 24 in that the bolt 14 is passed down through the bore 22 in the housing 21 and screwed together with the lower locking lug 24. The cover part 5 is screwed by means of its threaded portion 7 into the threaded portion 20 in the housing 21. The telescopic operating rod 29, 32 is coupled to the U-shaped member 35 in that the eccentric cross bar 36 is taken out, the cylindrical bodies 34 are placed inside the respective receiving members 27 and the cross pin 36 is then put in place, with engagement in the cross groove 33.

The use and the mode of operation of the new container lock will now be described in more detail, with particular reference to FIGS. 2–7.

Figure 3:
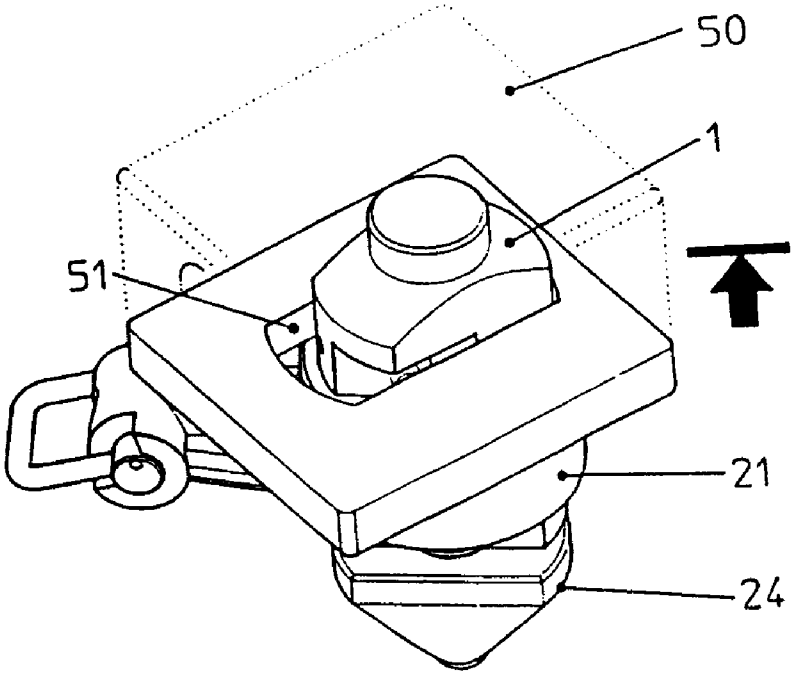
FIGS. 3–7 show fixing of the container lock in the upper container corner and locking of the container lock in a subjacent container corner.
Figure 2:
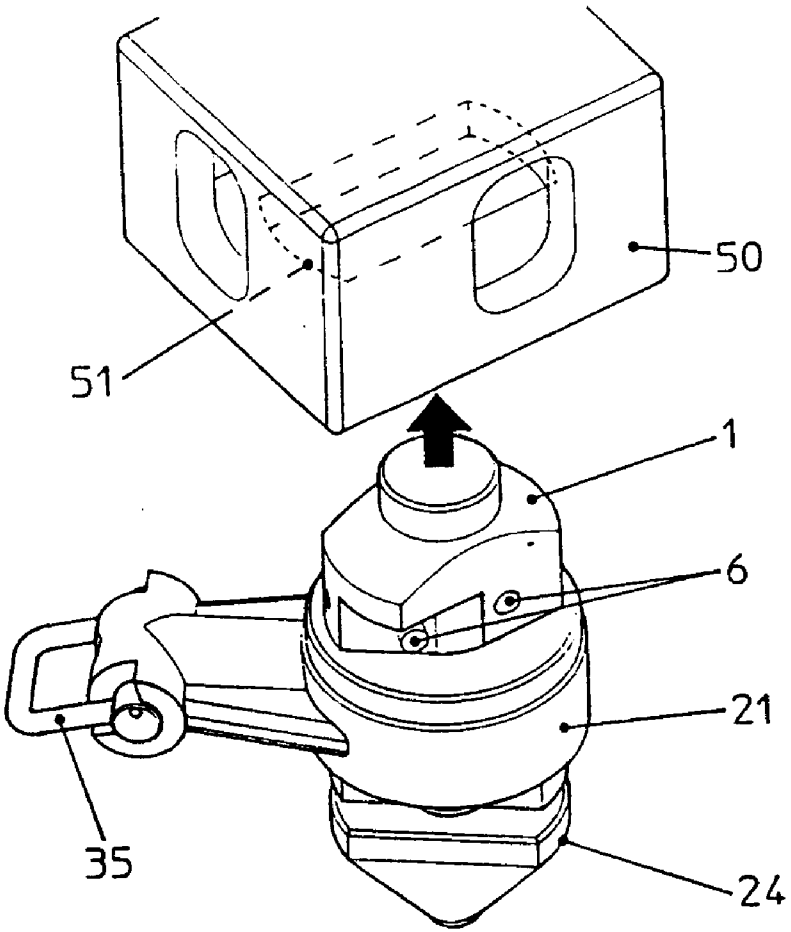
FIG. 2 shows a container lock according to the invention ready for insertion into a lock groove in an overlying corner.
Figure 5:
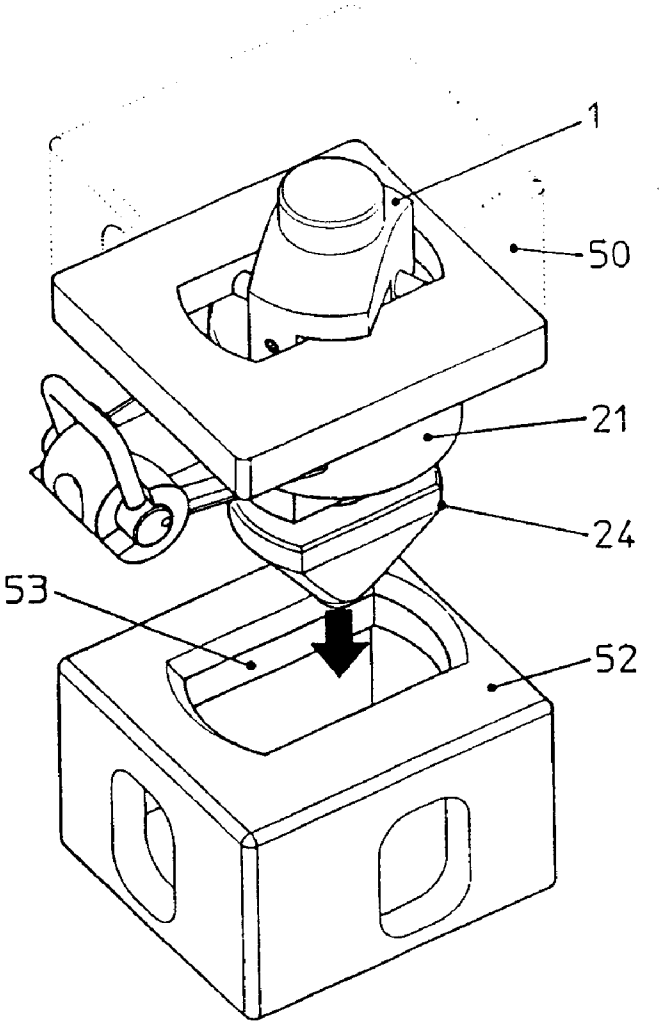
Figure 4:
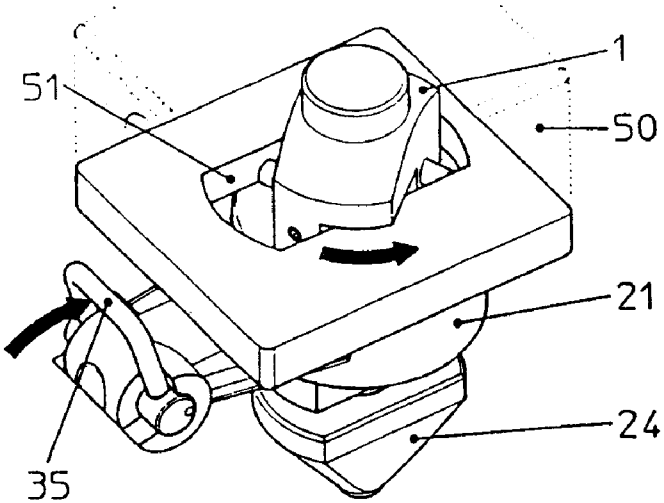
Figure 6:
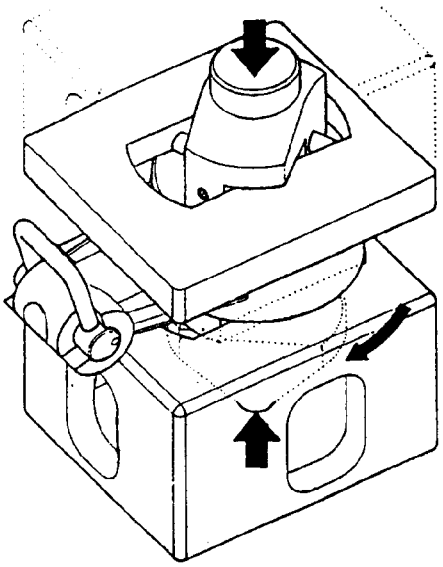
Figure 7:
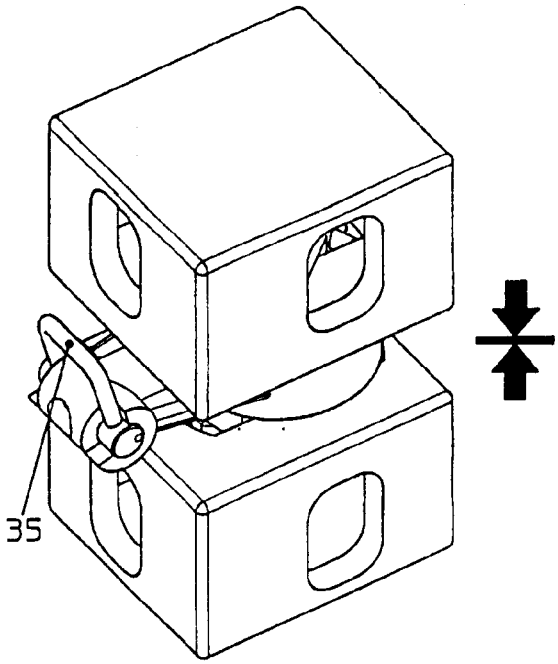
Figure 8:
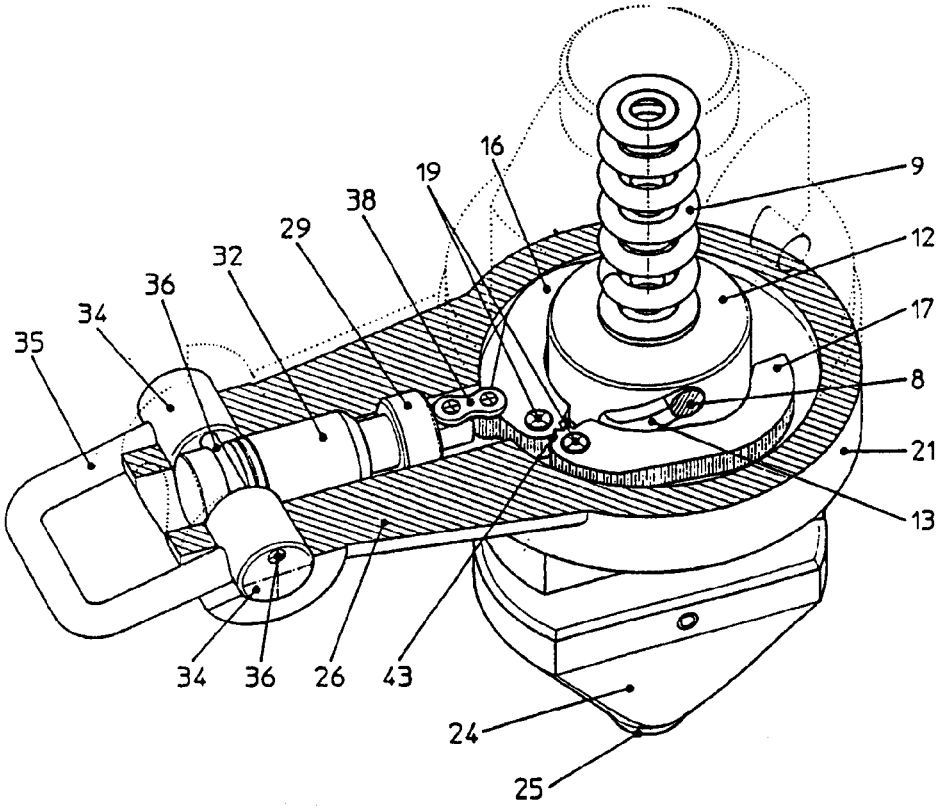
FIG. 8 is a sectional view through the container lock, with the lower locking lug in insertion position.
Figure 12:
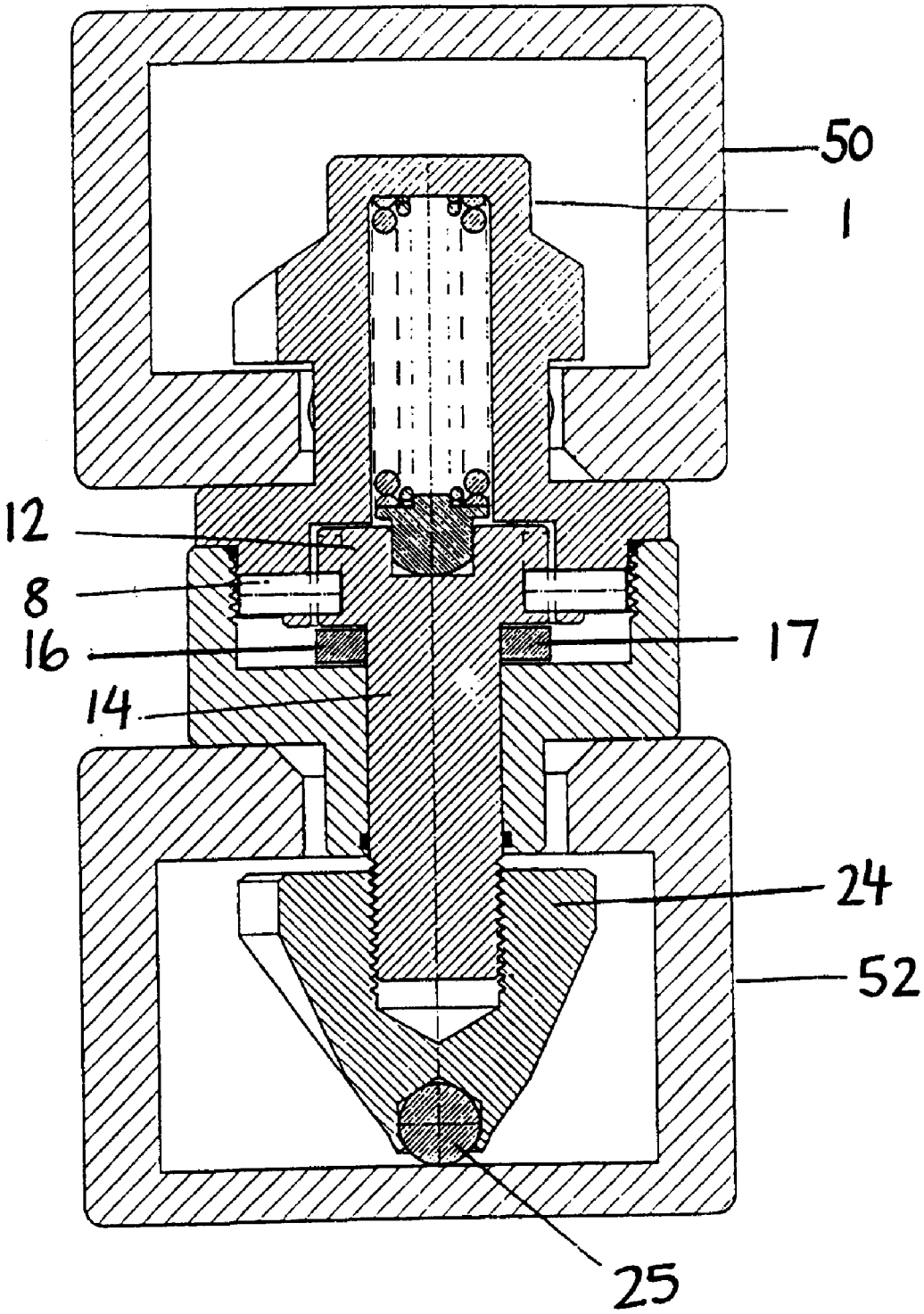
FIG. 12 shows the container lock in FIG. 11 when inserted and locked.
Figure 13:
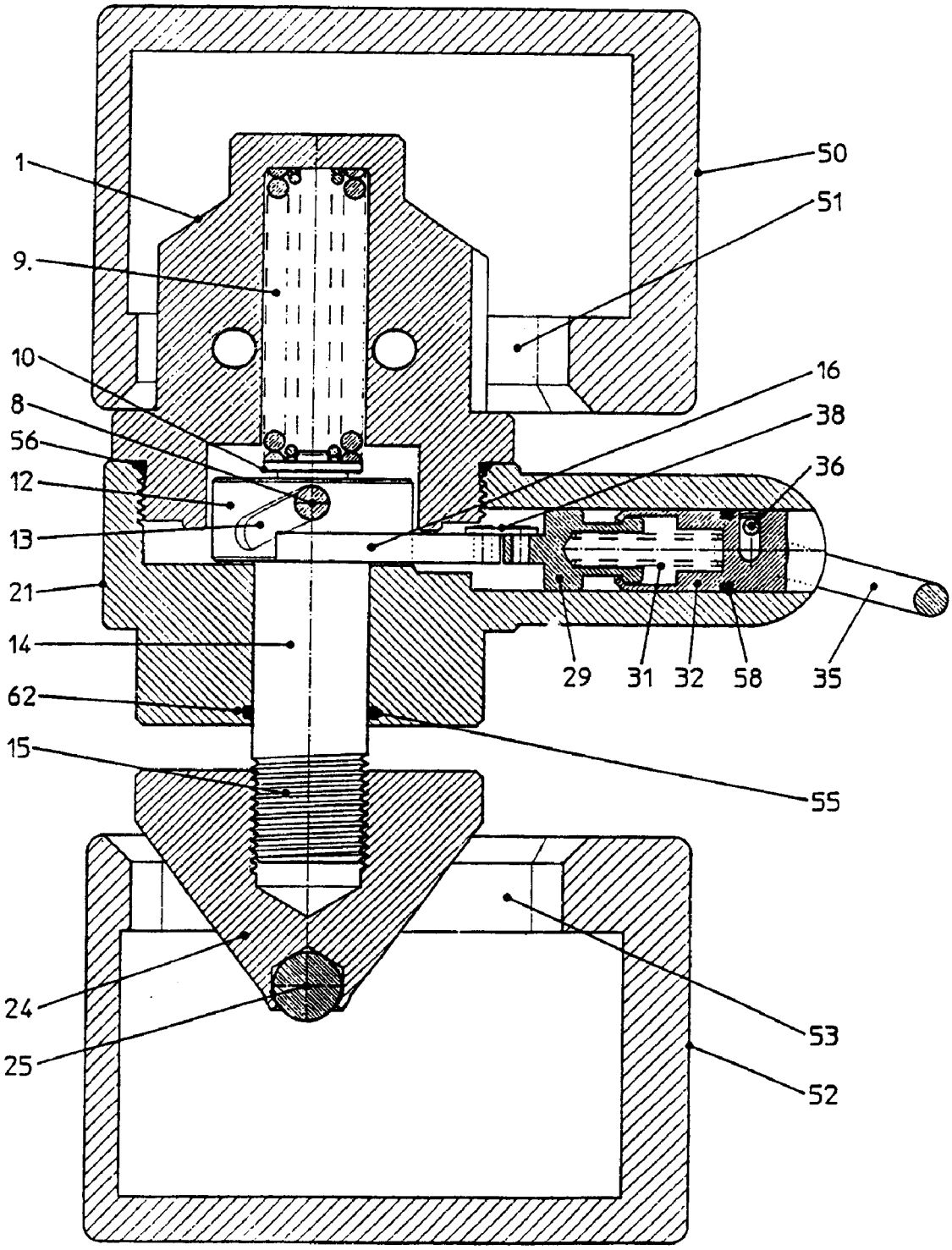
FIG. 13 is a longitudinal section through the container lock, taken at 90° to the longitudinal section in FIG. 11.
Figure 14:
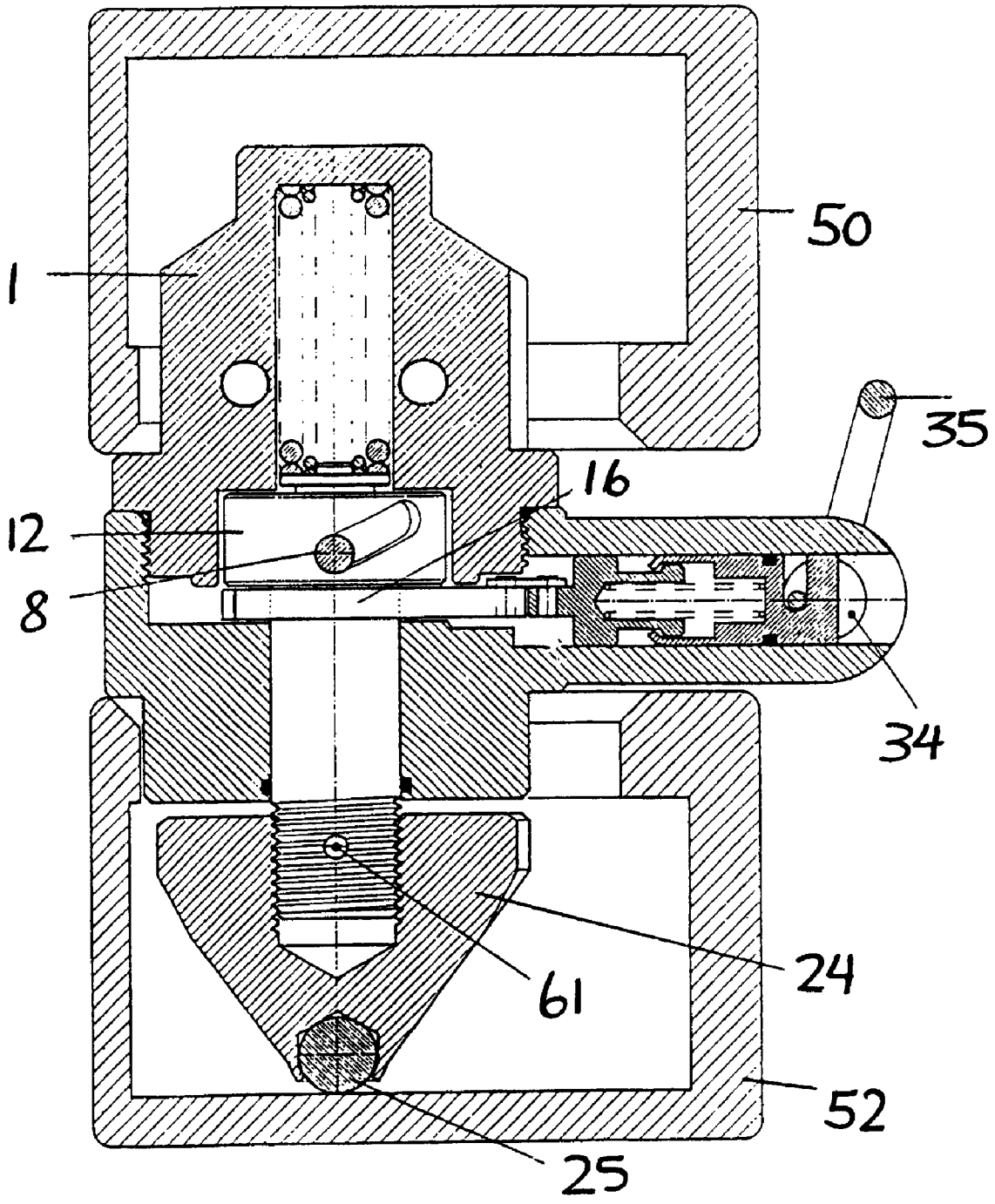
FIG. 14 is a sectional view of the container lock as in FIG. 13, but in the inserted and locked position.
Figure 15:
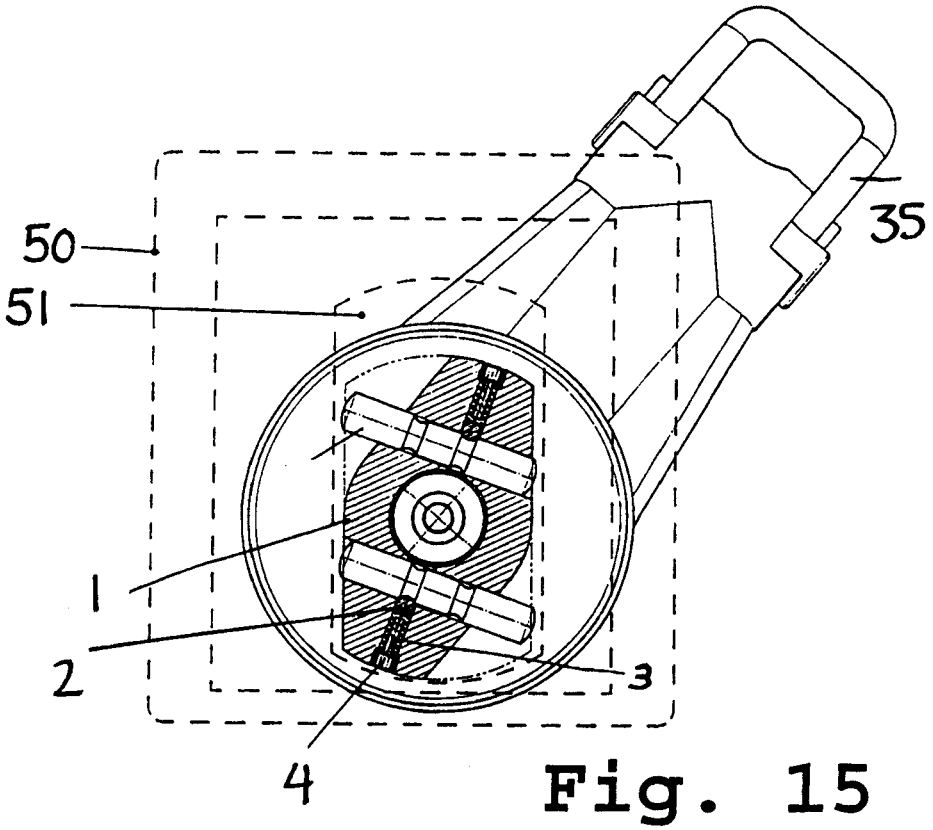
FIG. 15 is a sectional view through an upper locking lug in insertion position.
Figure 16:
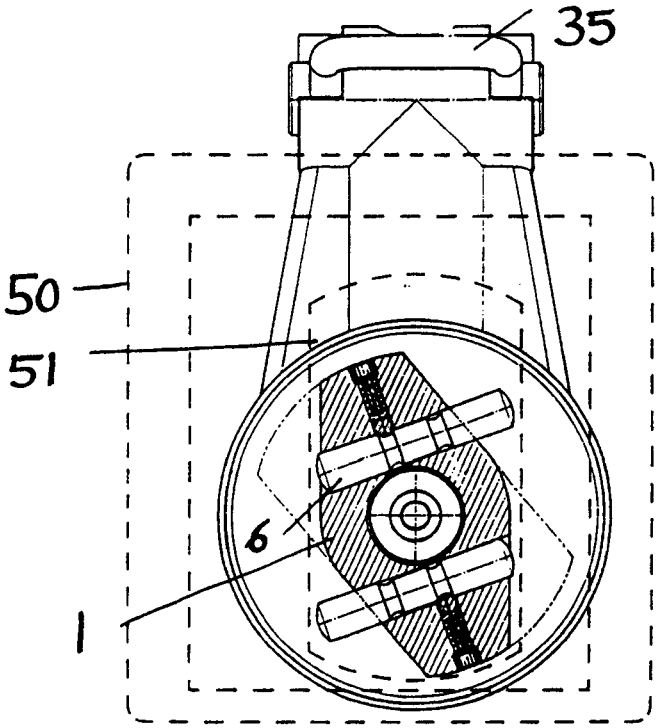
FIG. 16 is a sectional view as in FIG. 15, with the locking lug in turned locking position.

The container lock shown in FIG. 2, where the main components 1, 21 and 24 are indicated, is ready for connection with a superposed container corner 50 which has a downward facing lock groove 51. The U-shaped member 35 has been swung down, which means that the eccentric mechanism 33, 36 does not pre-tension the spring 31. The container lock is passed into the lock groove 51, as shown in FIG. 3, and is turned as shown in FIG. 4. The U-shaped member 35 is swung up as shown in FIG. 4, whereby the spring 31 (FIG. 1) is pre-tensioned, the portions 32 and 39 being pressed together by means of the eccentric mechanism 36, 33. The claws 16, 17 bear against the head 12, see FIG. 8, and will now be pre-tensioned relative to the shaft head 12. The upper locking lug 1 is now brought into locking interaction with the container corner 50. The lower locking lug 24 will be positioned and ready for insertion into a subjacent container corner 52, as shown in FIG. 5. When the container lock is lowered into the lock groove 53 in the container corner 52, the ball 25 on the lower locking lug 24 will move towards a bottom abutment (FIGS. 12, 14). Thus, the lower locking lug 24 and its shaft 14 are pressed upwards, with simultaneous rotation of the shaft 14 and the locking lug 24, as a consequence of the interaction between the oblique guide grooves 13 and the guide pins 8. This is shown in FIG. 6. FIG. 7 shows the two container corners 50, 52 locked together by means of the container lock.

Figure 9:
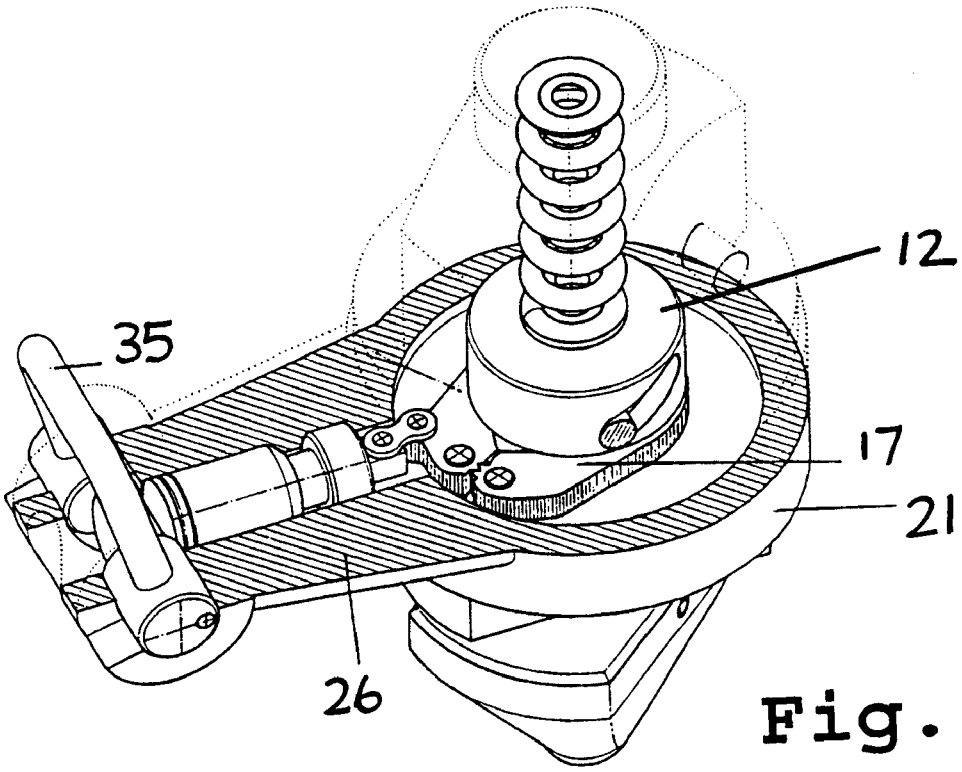
FIG. 9 is a sectional view through the container lock as in FIG. 8, but with the lower locking lug in a locking position.
Figure 10:
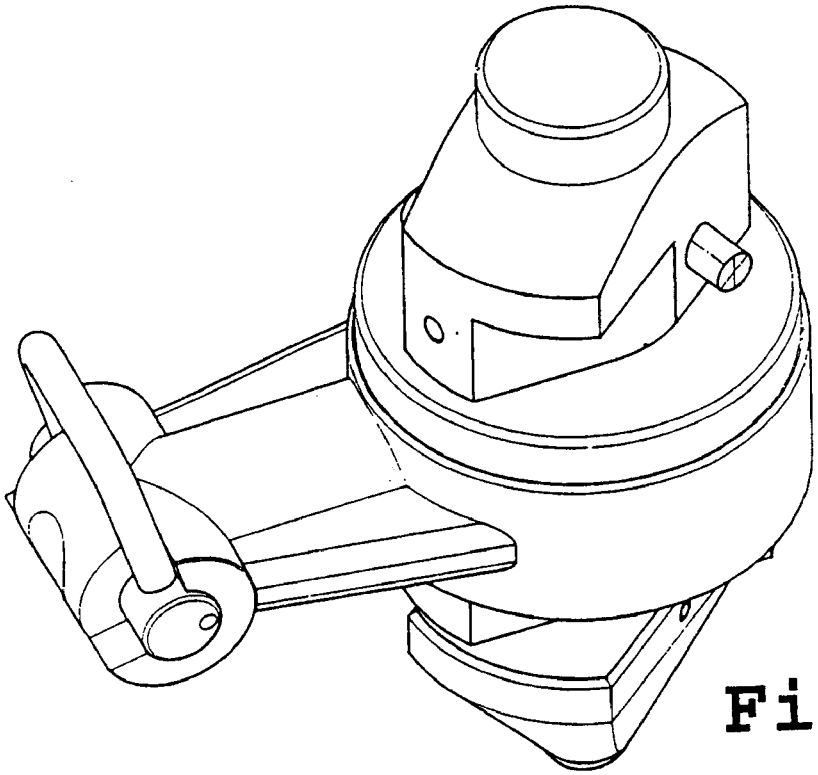
FIG. 10 is a perspective view of the container lock in the locking position shown in FIG. 9.
Figure 11:
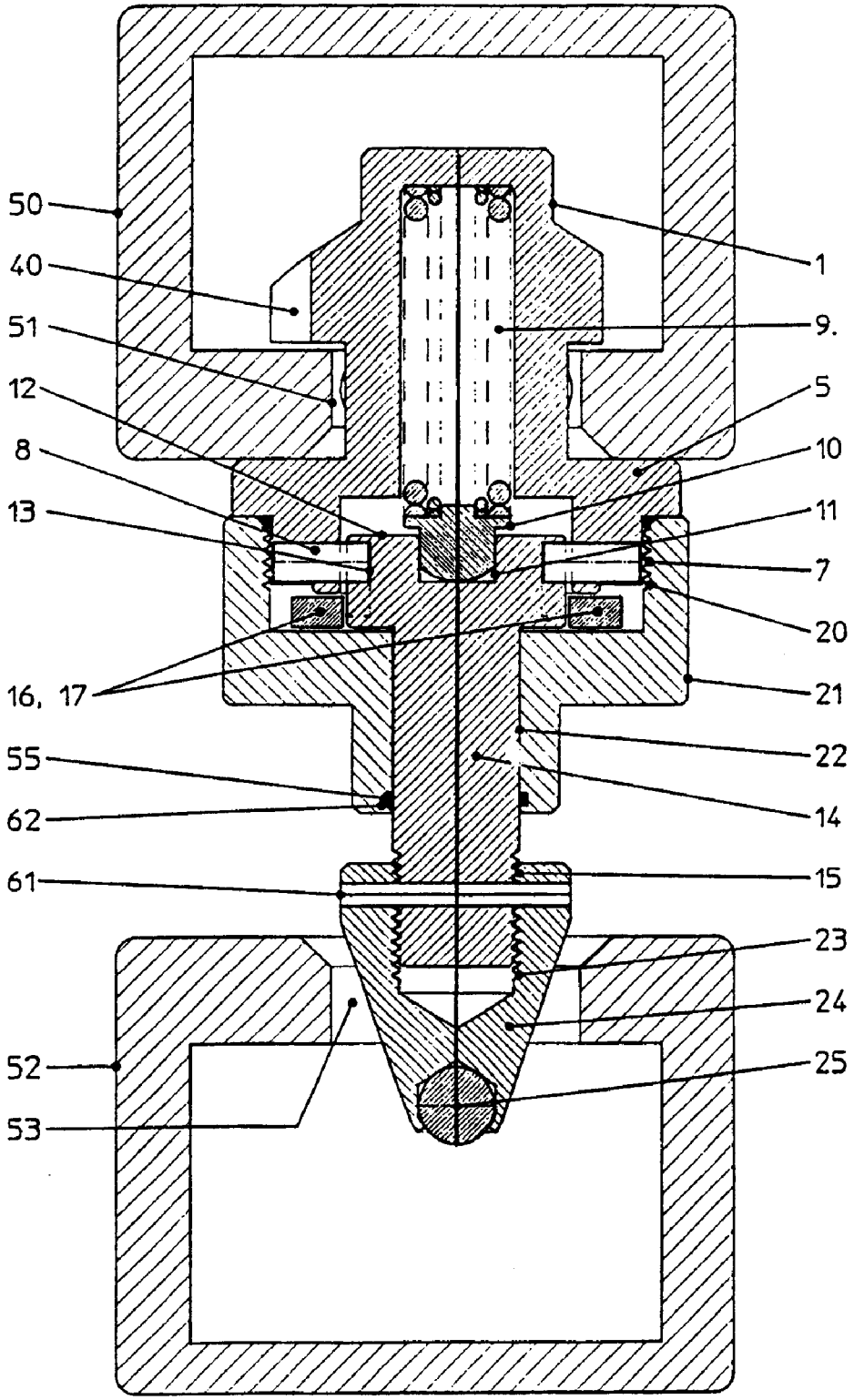
FIG. 11 is a longitudinal section of the container lock during insertion into a lower lock groove.

The shaft or bolt 14 is pushed up against the action of the spring 9 so that the two claws 16, 17 have now snapped into place under the head 12 of the bolt 14, as is shown in FIG. 9. The claws 16, 17 snap into place under the action of the pre-tensioned spring 31 which is in the telescopic operating rod 29, 32. This locking of the head 12 of the bolt 14 means that the lower locking lug 24 cannot move downwards, despite it being urged in a downward direction by the tension spring 9. The lock connection in FIG. 7 will therefore be secured.

The upper locking lug 1 is secured by means of ball and groove locking pins 6, see FIGS. 1, 2, 4, 15 and 16. In the upper locking lug 1 there are two through bores 41 which open into each of the respective recesses 40 and initially are in a position where they extend into the respective recesses, as shown in FIG. 2. The pins 6 are retained in this position by means of a respective ball 2 which runs in a cross bore and is actuated by a spring 3 and a nut 4, in a well known way for ball-and-groove locking pins. In this position, the ball 2 interacts with one of the two circumferential grooves on the respective pin 6.

When the upper locking lug 1 is passed into the lock groove 51 and turned as shown in FIG. 4, the two pins 6 will run against their respective walls in the lock groove 51 and be displaced as shown by the arrows in FIG. 4 to a position in which the respective detent ball 2 has a locking interaction with the other of the two circumferential grooves on each of the pins 6. This means that the upper locking lug 1 will be locked with a certain resistance in the rotational locking position shown in FIG. 4 (see also FIGS. 15 and 16).

When the lock in FIG. 7 is to be released, the U-shaped member 35 is swung down to a position as shown, for example, in FIG. 2. The spring 30 is thus relieved of tension and the operating rod is pulled out so that the claws 16, 17 are spread and release the head 12 of the bolt 14. The spring 9 will now press the bolt 14 and the lower locking lug 24 downwards. The container lock can now be turned and released from the upper lock groove 51. Subsequently, the container lock can be removed from the lower container corner 52.

The design of the container lock is such that it can be opened and closed by the U-shaped member 35 when the container lock is in place between two juxtaposed container corners because the pair of claws 16, 17 will not be loaded by the head 12, see FIG. 14. It is only by lifting (the ball 25 is lifted from the bottom abutment) that the spring 9 will press the head 12 downwards into abutment against the subjacent pair of claws 16, 17 and cause the operating mechanism to be friction-locked.

Advantageously, the container lock may be equipped with inserted O-rings 55, 56 and 58. These O-rings will define a sealed chamber wherein advantageously oil or the like may be introduced to prevent water penetration and condensation. In order to prevent particles from penetrating into the container lock, and also to make the container retentive of any internal liquid filling in order thereby to prevent corrosion, an O-ring 56 is placed in a 45° chamfer 57 in the outlet of the threaded portion 20 on the housing 21. When the locking lug 1 and the housing 21 are screwed together, there is thus a leakproof connection.

Similarly, an O-ring 55 is fitted in a groove 62 at the bottom in the through bore 22 in the bottom of the housing 21. The O-ring seals against the screw 14.

Likewise, an O-ring 58 is fitted in a groove 57 on the outer rod portion 32. This O-ring seals against the radial through passage 28 in the housing part 26.

Figure 17:
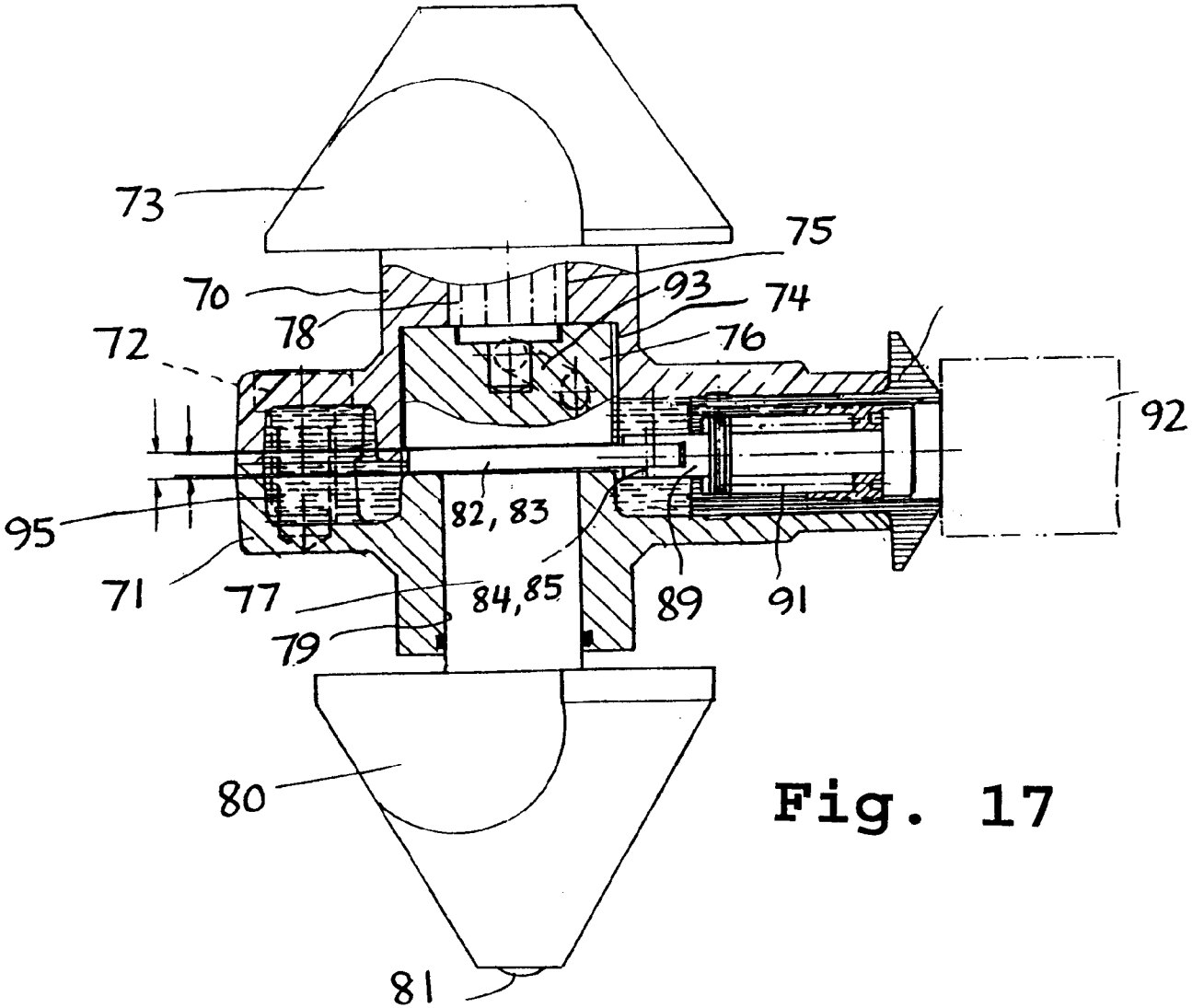
FIG. 17 is a longitudinal section of an especially advantageous embodiment of the invention.
Figure 18:
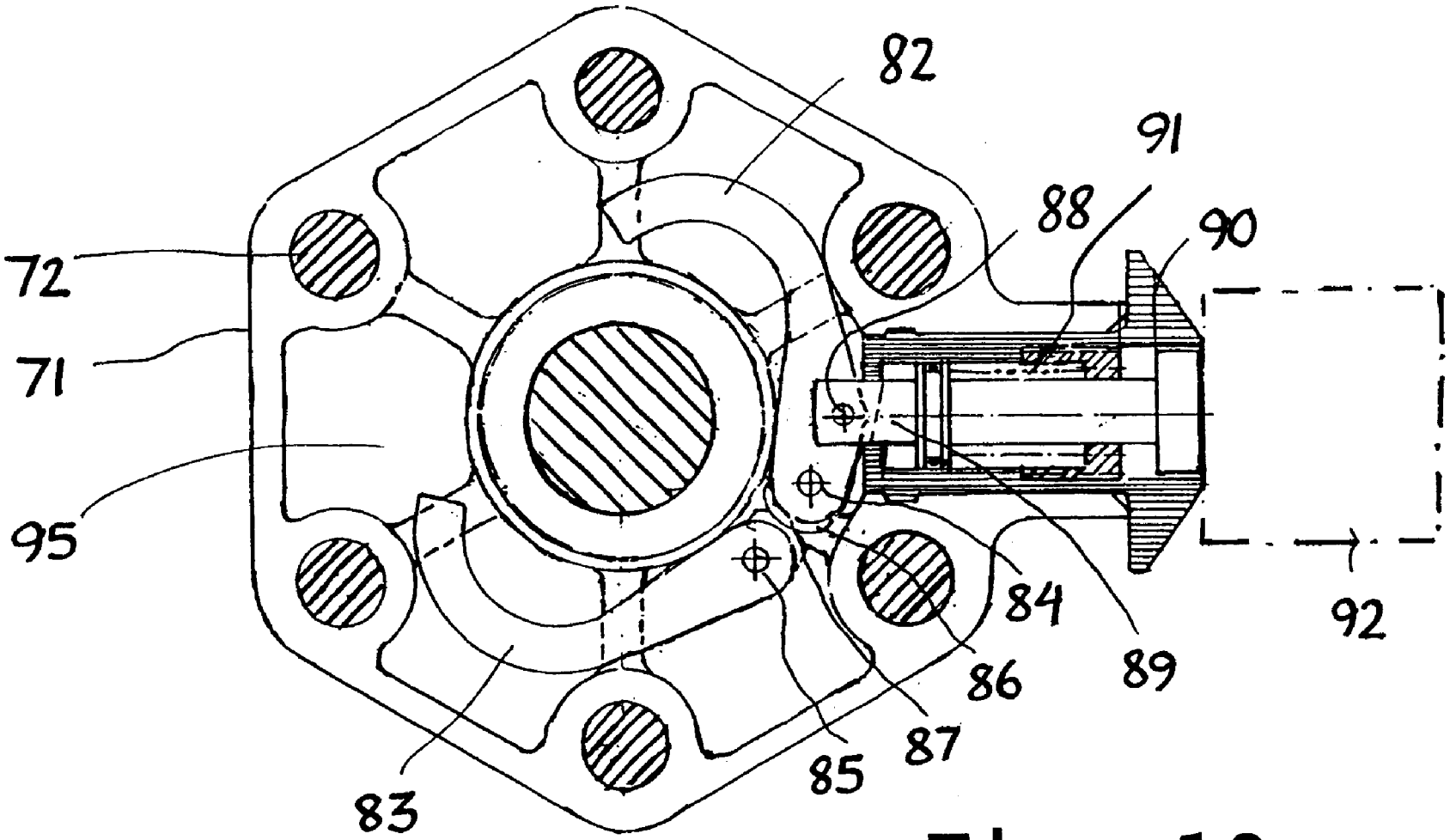
FIG. 18 is a sectional view through the embodiment in FIG. 17, taken in the dividing plane between the two housing halves.

FIGS. 17 and 18 show another especially preferred embodiment of a container lock according to the invention.

This container lock has two juxtaposed housing halves, an upper housing half 70 and a lower housing half 71. The two housing halves 70, 71 are screwed together with screws 72.

An upper locking lug 73 is integrally formed with the upper housing half 70. As shown in FIG. 17, there is cut out in the upper housing half 70 a stepped blind bore 74, 75 for receiving respectively the head 76 of the shaft 77 and a compression spring 78 which presses against the head 76 of the shaft.

The shaft 77 is rotatably mounted in a through bore 79 in the lower housing half 71 and supports a lower locking lug 80. The locking lug 80 has a thrust ball 81 intended for abutment against the bottom of the lock groove, not illustrated in this case, in a container corner. In this embodiment too, a locking device is arranged in the housing for the shaft 76, 77. Here, the locking device is also in the form of a pair of claws 82, 83 which are pivotally mounted in the housing 70, 71 by means of pivot pins 84 and 85. The claws 82, 83 have interacting toothing 86, 87 and one of the claws 82 has a bore for a pin 88 which connects the claw 82 with a piston 89.

The piston 89 is slidably arranged in a sleeve 90 and is actuated by a tension spring 91 in the sleeve. The tension spring 91 acts to swing the claws 82, 83 from the free position shown in FIG. 18 to a locking position under the head 76 of the shaft, as shown in FIG. 17. An electromagnet 92, when supplied with power, draws the piston 89 inside the sleeve 90, against the action of the spring 91. The pair of claws 82, 83 is thus opened and releases the shaft 76, 77. The spring 78 will then move the shaft 76, 77 in a downward direction.

As in the first embodiment, there is provided a guiding system 93 (corresponding to 8, 13 in the previous example).

It will be appreciated that the embodiment shown in FIGS. 17 and 18 functions on the same principles as explained in connection with the embodiment in FIGS. 1–16.

Special mention should be made of the fact that loading will cause a gap to be formed between the bottom of the housing 21 and the head 12 of the shaft 14 and between the head 76 and the subjacent annular surface in the lower housing part 71, so that the two claws 16, 17 and 82, 83, respectively can pivot relatively freely, without greater resistance than that yielded by the springs 31 and 91, respectively (about 1 kilo). The two claws 16, 17; 82, 83 will move to the locking position without appreciable resistance. The two locking lugs will be rigidly interconnected, and will form a unit, which almost without the exertion of force can be separated when, e.g., a vessel moors in a dock, but which in the event of a storm will resist great forces.

The two housing halves 70 and 71 together form a chamber 95 which is fluid-filled, i.e., filled with cold-resistant oil, so that icing is prevented and contaminants cannot prevent the locking function.

What is claimed is:

1. A container lock including an upper and a lower locking lug (1, 24) cap able of being passed into a respective lock groove (51, 53) in juxtaposed container corners (50, 52) and turned so as to lock therein in that the lower locking lug (24) is rotatably and translationally mounted in a housing (21) connected to the upper locking lug (1) and having a shaft (14) capable of limited movement in the axial direction, which is lock actuated by a spring (9) in the housing (21) in a downward direction, and between the housing (5, 21) and the shaft (14) there are arranged guide means (13, 8) which permit a locking rotation of the lower locking lug (24) on upward movement of the shaft (14), characterised in that the lower locking lug (24) is designed to have a pressure ball (25) intended for abutting interaction with a bottom of a lock groove (53) when an upper container is placed on a lower container, so that the housing (21) is thus pressed down onto the shaft (14), whereby a gap is formed between a downward facing circumferential annular surface on the shaft (14) and the lower part of the housing (21), and in that in the housing (21) there is arranged a locking device including spring actuated (31) locking arms (16, 17) which will move in towards the shaft (14) to a position in the gap below the circumferential annular surface and thus as a spacer prevent the return axial movement of the shaft (14).

2. A container lock according to claim 1, characterised in that the locking arms of the locking device comprise a hinged pair of claws (16, 17) designed to have interacting swivel toothing (43) and which grip about the shaft (14).

3. A container lock according to claim 1, characterised by a spring-actuated (31) operating member (29, 32) for a locking arms (16, 17).

4. A container lock according to claim 3, characterised in that the operating member (29, 32) of the locking device, together with tension spring (31), is arranged in a radially projecting part (26) of the housing (21).

5. A container lock according to claim 3, characterised in that the operating member (89) is drive-connected to an electromagnet (92).

6. A container lock according to claim 1, characterised in that the said spring (9) for tension-actuation of the shaft (14) is a spring which acts against a free end (10, 11, 12) of the shaft (14).

7. A container lock according to claim 1, characterised in that the said guide means (13, 8) include at least one helical guide groove (13) on the shaft (14) and a guide pin (8) fixedly arranged radially in the housing (5, 21) and which passes into the guide groove (13).

8. A container lock according to claim 1, characterised by ball-and-groove locking pins (6) in the upper locking lug (1) or the housing (5, 21) for interaction with walls in a lock groove (51).

9. A container lock according to claim 1, characterised in that the shaft (14) is a screw bolt screwed into the lower locking lug (24).

10. A container lock according to claim 1, characterised in that the housing (21) is sealed off from the outside and filled with oil.

* * * * *

UNITED STATES PATENT AND TRADEMARK OFFICE

CERTIFICATE OF CORRECTION

PATENT NO. : 6,334,241 B1
DATED : January 1, 2002
INVENTOR(S) : Yngve Flodin

It is certified that error appears in the above-identified patent and that said Letters Patent is hereby corrected as shown below:

Column 2,
Line 27, after “overlying” insert -- container --.

Column 6,
Line 36, change “cap able” to -- capable --.
Line 64, change “for a” to -- for the --.

Signed and Sealed this

Eighteenth Day of November, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,334,241 B1
DATED : January 1, 2002
INVENTOR(S) : Yngve Flodin

It is certified that error appears in the above-identified patent and that said Letters Patent is hereby corrected as shown below:

Column 1,
Line 25, change “above,” to -- above, --.

Column 2,
Line 27, after “overlying” insert -- container --.

Column 6,
Line 36, change “cap able” to -- capable --.
Line 64, change “for a” to -- for the --.

Signed and Sealed this

Twentieth Day of July, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,334,241 B1
DATED : January 1, 2002
INVENTOR(S) : Yngve Flodin

It is certified that error appears in the above-identified patent and that said Letters Patent is hereby corrected as shown below:

Column 1,
Line 25, change “above.” to -- above, --.

Column 2,
Line 27, after “overlying” insert -- container --.

Column 6,
Line 36, change “cap able” to -- capable --.
Line 64, change “for a” to -- for the --.

This certificate supersedes Certificate of Correction issued July 20, 2004.

Signed and Sealed this

Twenty-first Day of December, 2004

JON W. DUDAS
*Director of the United States Patent and Trademark Office*